US009721545B2

(12) United States Patent
Jancic

(10) Patent No.: US 9,721,545 B2
(45) Date of Patent: Aug. 1, 2017

(54) CARRYING DEVICE FOR A WIND INSTRUMENT

(76) Inventor: Silvin M. Jancic, Villmergen (CH)

( * ) Notice: Subject to any disclaimer, the term of this patent is extended or adjusted under 35 U.S.C. 154(b) by 14 days.

(21) Appl. No.: 13/993,679

(22) PCT Filed: Dec. 6, 2011

(86) PCT No.: PCT/IB2011/055476

§ 371 (c)(1),
(2), (4) Date: Jun. 12, 2013

(87) PCT Pub. No.: WO2012/080902

PCT Pub. Date: Jun. 21, 2012

(65) Prior Publication Data

US 2013/0263718 A1 Oct. 10, 2013

(30) Foreign Application Priority Data

Dec. 13, 2010 (CH) ..... 2071/10

(51) Int. Cl.
*G10D 7/00* (2006.01)
*G10D 9/00* (2006.01)
*G10G 5/00* (2006.01)

(52) U.S. Cl.
CPC ..... *G10D 9/00* (2013.01); *G10G 5/005* (2013.01)

(58) Field of Classification Search
CPC G10D 9/00; G10G 5/00; G10G 5/005; G10G 7/00; G10K 5/00; G10K 9/04
USPC ..... 84/380 R, 421; D17/20
See application file for complete search history.

(56) References Cited

U.S. PATENT DOCUMENTS

| | | | | |
|---|---|---|---|---|
| 2,854,880 | A * | 10/1958 | Waters | 84/421 |
| 4,298,149 | A * | 11/1981 | Gottschalk et al. | 224/201 |
| 5,042,763 | A * | 8/1991 | Wong | F16M 13/02 224/265 |
| 5,873,503 | A * | 2/1999 | Atherton et al. | 224/259 |
| 6,764,231 | B1 * | 7/2004 | Shubert | F16M 13/04 396/419 |
| 7,655,853 | B1 * | 2/2010 | Ricca | 84/385 A |
| 8,646,666 | B2 * | 2/2014 | May | 224/265 |
| 2005/0145094 | A1 * | 7/2005 | Shumake | G10G 5/005 84/453 |

FOREIGN PATENT DOCUMENTS

| | | | | |
|---|---|---|---|---|
| DE | 299 08 209 U1 | 11/1999 | | |
| FR | 2924002 A1 * | 5/2009 | | A45F 3/14 |

* cited by examiner

*Primary Examiner* — Jianchun Qin
(74) *Attorney, Agent, or Firm* — Seed IP Law Group LLP

(57) ABSTRACT

The invention relates to a device for carrying a wind instrument. The device comprises a Y-shaped frame having two arms (2, 2') extending upward, which are arcuate at the free ends (9) of the arms, and a third arm extending downward, which forms a support (4). The two arms (2, 2') and the support (4) converge in a connecting element (3) and are connected to each other there. The arms (2, 2') can be designed as one piece together with the support (4) and the connecting element (3) in order to form a unit, or the arms (2, 2') can be connected to the connecting element (3) in an insertable or pivotable manner. A retaining element (5) for hanging the wind instrument (17) is provided on the connecting element (3).

15 Claims, 6 Drawing Sheets

CARRYING DEVICE FOR A WIND INSTRUMENT

REFERENCE TO RELATED APPLICATIONS

This application is the US national phase entry of International Patent Application no. PCT/IB2011/055476, filed Dec. 6, 2011, which claims priority to Swiss patent application no. 02071/10, filed Dec. 13, 2010.

FIELD OF THE INVENTION

The invention relates to a carrying device for a wind instrument, in particular for a saxophone or a saxophone-type wind instrument.

BACKGROUND

In general, holders made of a band approximately 2 cm wide, which are placed over the head and around the neck and have the form of a sling, and on the opposing free ends of which a movable hook is attached, which holds the respective wind instrument, are generally known as carrying devices for a saxophone. The disadvantage of these neck slings, in particular in the case of longer playing time and heavier instruments, is that the weight of the wind instrument pulls on the nape of the neck or the cervical vertebrae and greatly strains the neck and shoulder musculature, which long-term saxophone players perceive to be unpleasant and annoying and which can result in neck and head pains. Further known types of carrying devices consist of a chest strap system having two loops, which enclose the shoulders and converge in front of the chest, where the instrument is suspended. Some of these chest strap systems also have a belt integrated in the strap system for stabilizing the carrying device. The disadvantage in the case of the chest strap systems is that the instrument cannot be moved away from the body to a sufficient extent, and that it obstructs the rib cage during breathing, so that unobstructed playing is no longer possible after some playing time. A further disadvantage is that the strap system cannot simply be put down in a playing pause. Time and some effort is required to put on or take off the chest straps. In addition, the chest straps are not particularly attractive, which is perceived by professional players in particular to be annoying at performances.

SUMMARY

It is therefore the object of the present invention to provide a carrying device of the type mentioned at the beginning, which does not obstruct the wind instrument player in any way, and which allows long and unimpaired playing.

This object is achieved by a carrying device for a wind instrument consisting of a Y-shaped frame having two upwardly protruding arms, which are formed as arcs on their free end, and a third arm which protrudes downward and which forms a support, wherein the two arms and the support converge in a connecting element and are connected to one another therein, and furthermore a fastening means is provided on the carrying device for suspending or fastening retaining means for a wind instrument.

The carrying device consists of three arms, which form a Y-shaped frame. The two arms which protrude upward are formed as arcs on their free ends, so that they can be hung over the shoulders of the player. The third arm, which protrudes downward, has its free end lying in the belly region of the player. The three arms are either integrally connected to one another to form a unit or converge in a connecting element, into which the arms are plugged or on which the arms are linked so they are pivotable. The wind instrument is hung by means of a cord or a band on a retaining element arranged in the region of the connection of the three arms. The carrying device is very light and can be put on or taken off with one movement. It does not obstruct the player in any way and permits the greatest possible mobility during playing.

Further advantages of the invention result from the dependent claims and from the following description, in which the invention is explained in greater detail on the basis of the exemplary embodiments shown as examples in the drawings.

DETAILED DESCRIPTION

The same reference signs are used in each case for the same elements and initial explanations relate to all figures, if not otherwise expressly noted.

Figure 1:
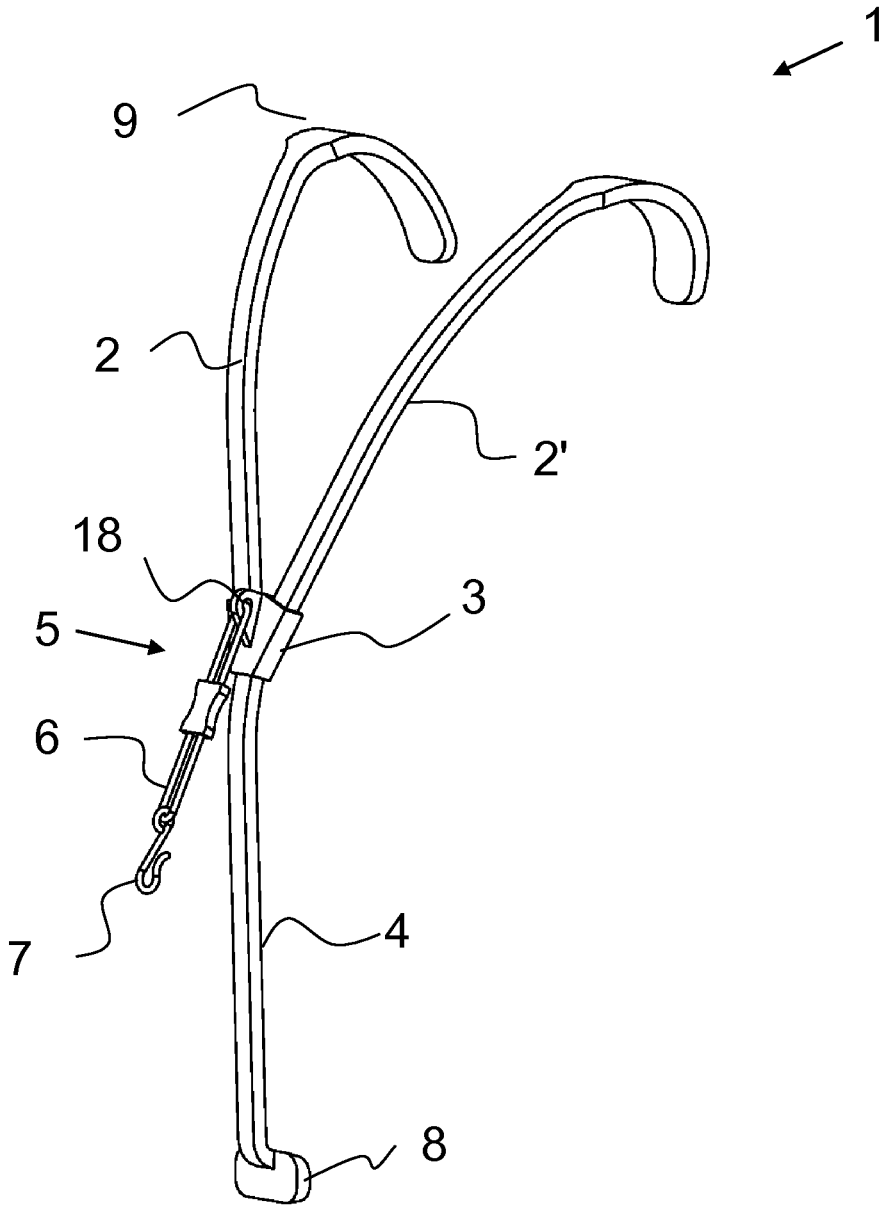
FIG. 1 shows a schematic illustration of the carrying device in a diagonal view.

FIG. 1 shows an exemplary embodiment of the carrying device 1 according to the invention. The device 1 consists of a Y-shaped frame, which is substantially formed by three arms, having two arms 2, 2' protruding upward, which are formed as arcs at their free ends 9, and a third arm, which protrudes downward, and which forms a support 4. The two arms 2, 2' and the support 4 converge in a connecting element 3, where they are fixedly connected to one another. The carrying frame 1 can be formed integrally or in multiple parts. If the carrying device consists of three individual parts, the two arms 2, 2' and the support 4, they are thus connected to one another by means of the connecting element 3, wherein the connecting element 3 is preferably fixedly connected to the support 4 or is formed onto the upper end of the support 4. The arms 2, 2' are removably plugged and latched in corresponding recesses in the connecting element 3, so that they are not pivotable in the latched state. The arms 2, 2' can be pulled out of the connecting element 3 for the transport of the carrying device. The three individual parts of the carrying device 2, 2', 4 are then simpler to transport than in the assembled state. The free ends 9 of the arms 2, 2', which are formed as arcs, are provided to rest on the shoulders of the player. For this purpose, they can be flattened, as shown in the drawing, or can also be cushioned to avoid pressure points. A fastening element 18, for example, an eye, on which the wind instrument can be suspended or fastened using retaining means 5, for example, a cord or a band 6, is provided on the connecting element 3. The longitudinally-adjustable band 6 has on the free end a hook 7 for suspending the wind instrument. At the lower free end of the support 4, it has a formed-on brace 8, which can also be formed by simply widening the support 4 in the lower end region. If the player has hung the carrying device 1 with the arced ends 9 of the arms 2, 2' over his shoulders, the brace 8 lies on the belly somewhat above the navel. A wind instrument suspended using retaining means 5 on the fastening element 18 pulls downward because of the weight. The traction is absorbed, on the one hand, by the shoulders, where the arms 2, 2' rest, on the other hand, the brace 8 presses against the belly. The player feels a slight counter pressure in the belly region as he breathes during playing. This is advantageous in particular for beginners, since they can thus easily monitor their breathing and improve their breathing technique.

Figure 2:
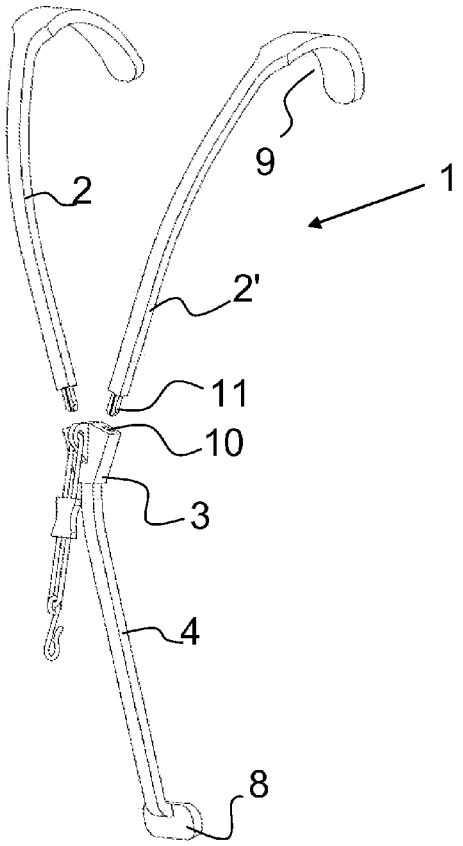
FIG. 2 shows a schematic illustration of the carrying device having arms, which can be plugged in, in a diagonal view.

FIG. 2 shows an exemplary embodiment of the carrying device 1 having arms 2, 2' which can be plugged in. The connecting element 3, which is formed onto the support 4, has two recesses 10, which are intended to accommodate the arms 2, 2'. For this purpose, catch elements 11, which removably latch when they are plugged into the recesses 10, are formed onto the lower ends of the arms 2, 2'. The plugged-in and latched arms 2, 2' are not pivotable in relation to one another or in relation to the support 4. The arms 2, 2' are therefore rigidly connected to the support 4.

Figure 3:
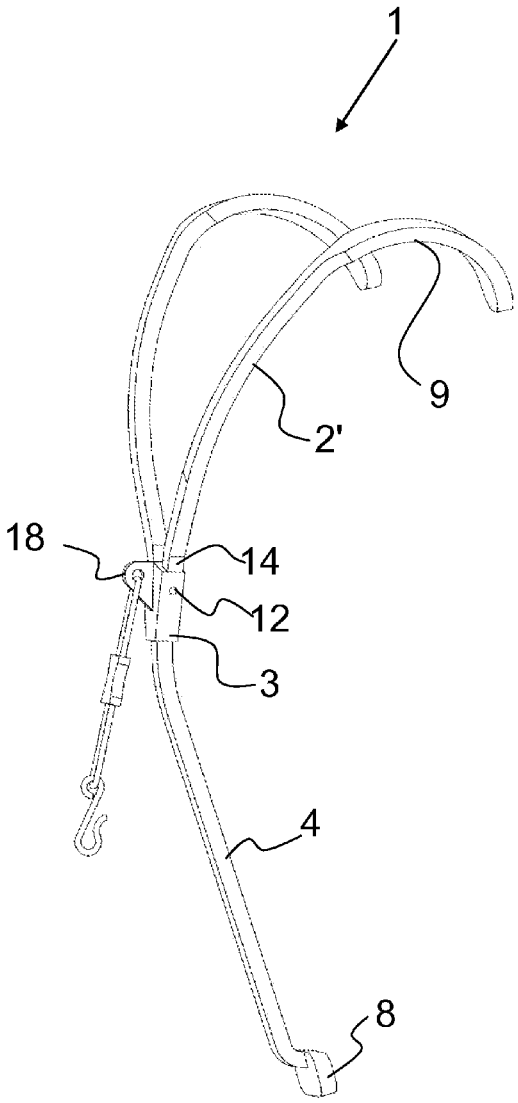
FIG. 3 shows a schematic illustration of the carrying device having pivotable arms in a diagonal view.

The arms 2, 2' of the carrying device 1 can also be connected in a pivotable manner to the support 8. Such an embodiment variant is shown in FIG. 3 in a diagonal view. The two arms 2, 2' are linked by means of a hinge-type connection to the connecting element 3 formed onto the support 4. For this purpose, the connecting element 3 has two slotted recesses, in which the ends 14 of the arms 2, 2' engage and are held therein by means of a pin 12, which forms the axis of rotation for the arms 2, 2'. This hinge-type connection allows only a restricted opening angle for the arms 2, 2'. Specifically, if the arms 2, 2' are in the stretched position in relation to the support, the ends 14 of the arms 2, 2' press against the inside of the recess of the connecting element 3. The arms 2, 2' and the support 4 are therefore only pivotable inward and have the stiffness in the opposite direction required for the support in the case of the load of the carrying device 1.

Figure 4:
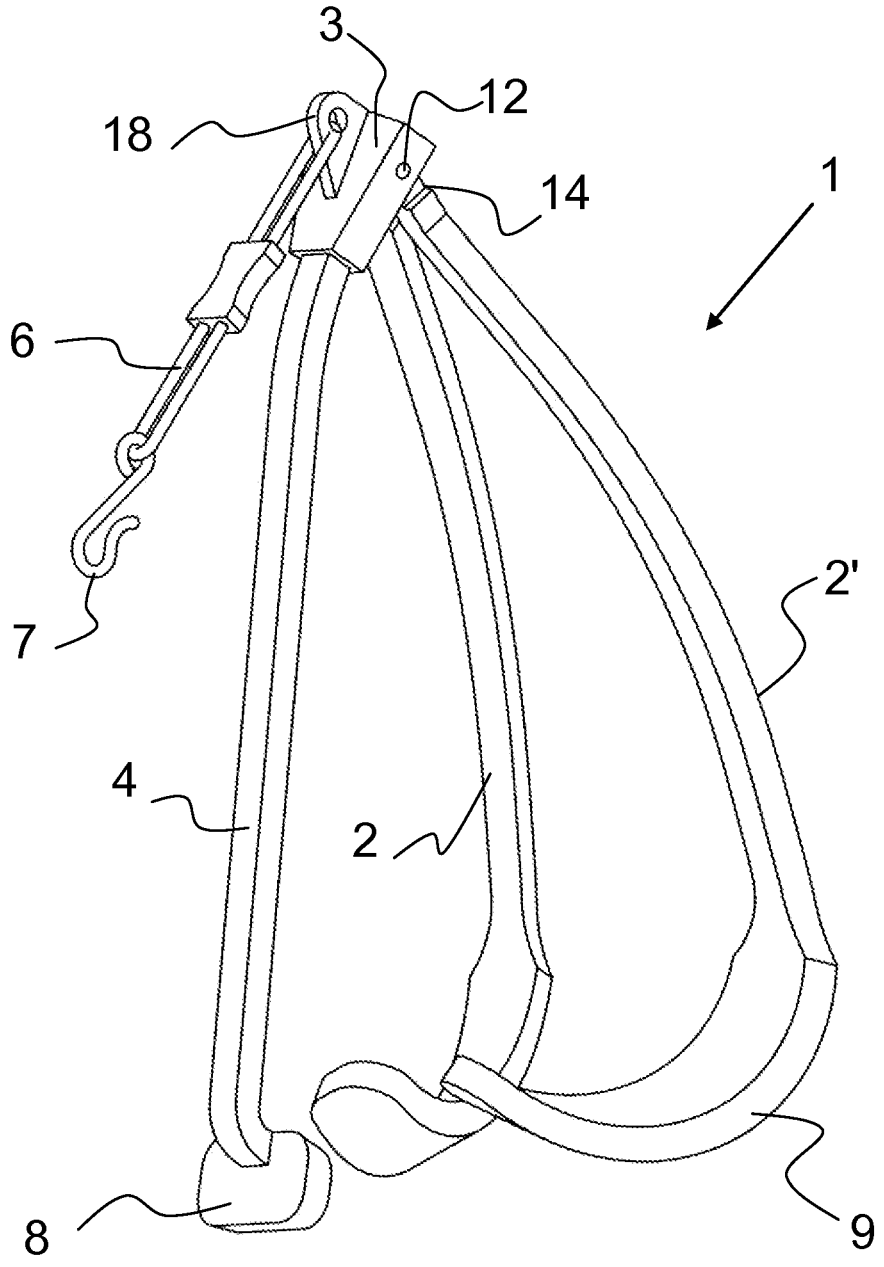
FIG. 4 shows a schematic illustration of the carrying device as in FIG. 3, but with pivoted arms.

FIG. 4 shows the carrying device 1 having arms 2, 2', which are linked on the connecting element 3, in the collapsed state. In this position, the carrying device can be packed and transported easily. For the usage of the carrying device 1, the two arms 2, 2' are folded up and hung using their arced free ends 9 over the shoulders. Now, the instrument only still has to be hung using the cord 6 and the hook 7 on the carrying device. The carrying device 1 can be put down just as easily after playing or in a playing pause with one movement.

Figure 5:
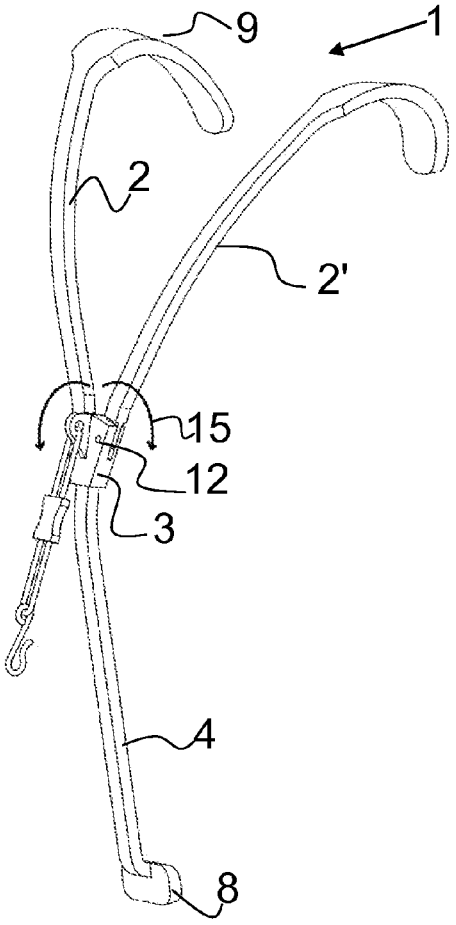
FIG. 5 shows a schematic illustration of the carrying device having laterally pivotable arms in a diagonal view.

FIG. 5 shows a further embodiment of the carrying device 1, in which the two arms 2, 2' are also linked by means of a hinge-type connection on connecting element 3. The two slotted recesses 16, in which the ends 14 of the arms 2, 2' engage, are arranged in such a manner that the two arms 2, 2' can be folded down laterally. The folding direction is indicated in the drawing with the arrows 15. This hinge-type connection allows only lateral pivoting of the arms 2, 2'. The arms 2, 2' and the support 4 are not pivotable in relation to one another in the direction toward the body of the wearer of the carrying device 1 and in the opposite direction. The carrying device 1 thus has sufficient stiffness so that a wind instrument suspended on the carrying device not only hangs on the arms 2, 2', but rather a part of the weight is supported via the support 4.

Figure 6:
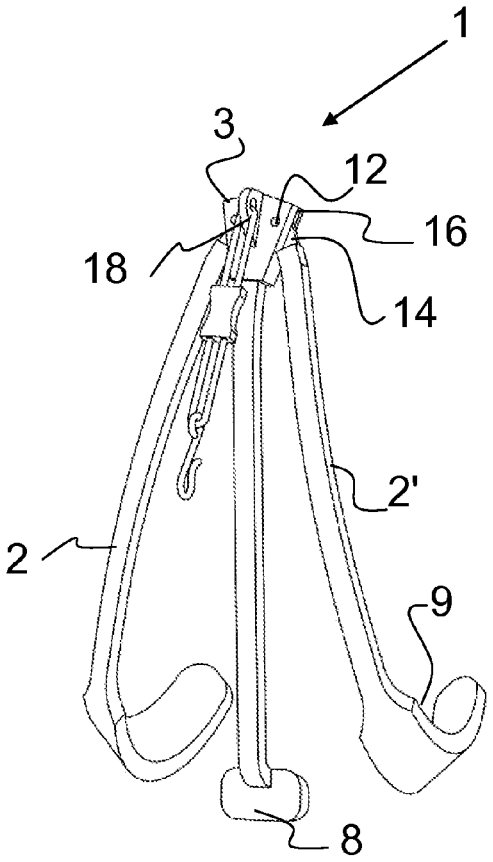
FIG. 6 shows a schematic illustration of the carrying device as in FIG. 5, but with lateral arms pivoted downward.

Due to the lateral folding down of the arms 2, 2', the carrying device is compactly collapsible and easy to pack and transport. FIG. 6 shows such a collapsed carrying device 1. For the usage of the carrying device 1, the two arms 2, 2' are merely folded up laterally, hung over the shoulders, and the instrument is hung on the carrying device 1.

Figure 7:
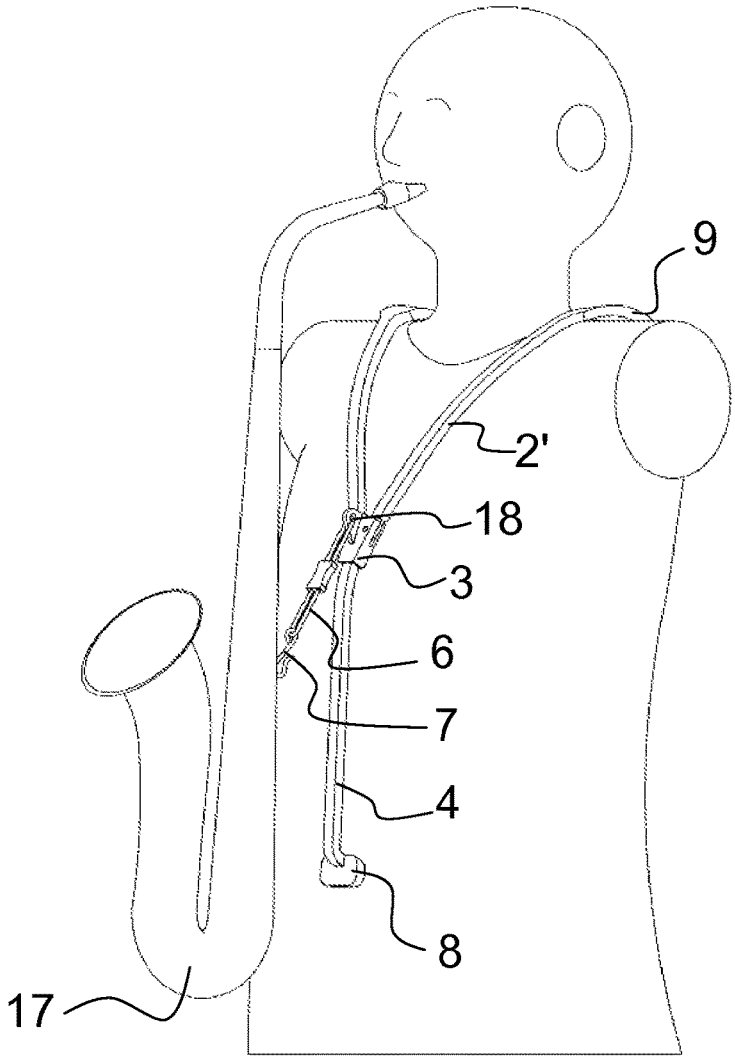
FIG. 7 shows the carrying device having music instrument hung thereon suspended on the shoulders of a person, schematically shown in a diagonal view.

FIG. 7 schematically shows a player having the carrying device 1 and a music instrument 15 suspended thereon in a diagonal view. The carrying device 1 hangs with the arced ends 9 of the arms 2, 2' on the shoulders of the player. The support 4 lies with the brace 8 on the belly of the player. The wind instrument 17 suspended on the carrying device 1 can be freely moved, does not obstruct the player in any way in his mobility during playing, and the player hardly feels the weight of the instrument on the shoulders.

Figure 8:
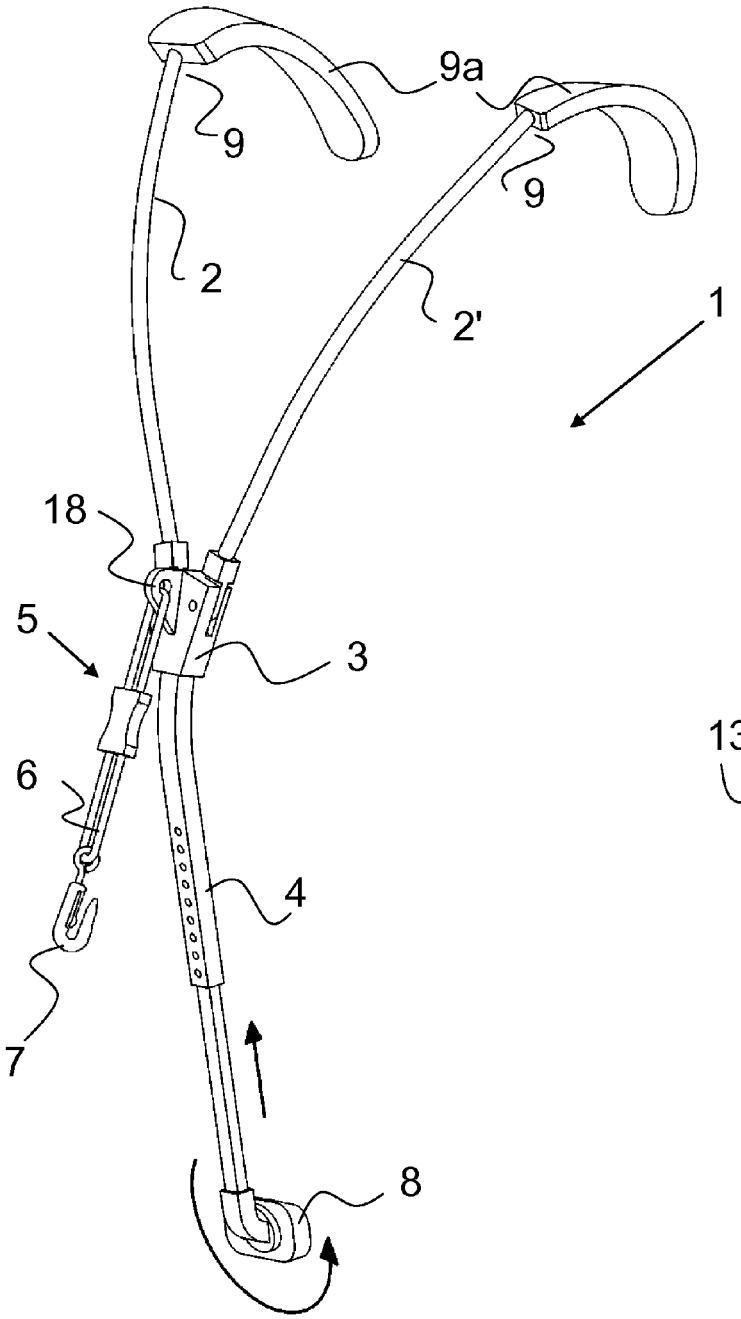
FIG. 8 shows a schematic illustration of the carrying device as in FIG. 5, but with adjustable support and rotatable and pivotable brace.
Figure 8B:
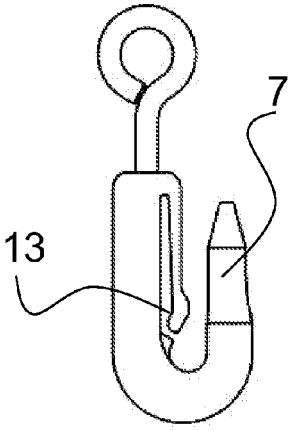
FIG. 8*b* shows a detail view of another hook for hanging the wind instrument.
Figure 8A:
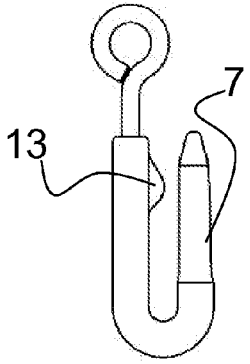
FIG. 8*a* shows a detail view of the hook for hanging the wind instrument.

FIG. 8 shows a further embodiment of the carrying device 1. The arms 2, 2' are manufactured from aluminum, so they can be adapted easily by bending to the body shape of the player. The ends 9 of the arms 2, 2' are provided with a rubber cushion 9*a*, to improve the wearing comfort. The support 4 has a telescopic extension 4*a* having a grid. The length of the support 4 can thus be varied and optimally adapted to the body size of the player. In addition, for transport, the telescopic extension 4*a* can be pushed into the top part of the support 4 as indicated by the arrow. The brace 8 is rotatable and is also arranged so it is pivotable in a small range at the lower end of the telescopic support 4*a* of the support 4. The arrow in the drawing indicates the rotational direction. Because the brace 8 is arranged so it is movable, i.e., pivotable, on the support 4, the device may also be collapsed more densely for transport. The hook 7, which is manufactured from steel with a plastic sheath, for suspending the wind instrument, has a safeguard, as shown in FIGS. 8*a*, 8*b*. This safeguard is to prevent the hook 7 from unintentionally disengaging from the eye on the instrument 17 during playing. The safeguard is formed by a constriction between the two legs of the U-shaped hook 7 and consists of a cam 13, which is formed onto the inner side of the U-shaped hook 7, or which is formed onto the free end of a spring tongue arranged on the inner side of the U-shaped hook 7.

The carrying device can be manufactured, for example, completely from plastic or at least partially from metal, as shown in FIG. 8. Because of the simple construction and the low material expenditure, the carrying device 1 has a low intrinsic weight and does not obstruct the wind instrument player in any way, which allows long and unimpaired playing. It can be put on or taken off with one movement. Depending on the embodiment and shaping of the arms 2, 2', the support 4, and the shoulder pad in the arced area 9, the carrying device 1 fulfills its task in the simplest models or in aesthetically more demanding models, of assisting the wind instrument player in holding his instrument, without obstructing or restricting him at the same time.

The invention claimed is:

1. A carrying device for carrying a wind instrument, comprising:

(a) two upwardly protruding upper arms, each having a free end and being formed of a material sufficient to retain a shape of the upwardly protruding upper arm when manipulating the carrying device in space;

(b) only one lower elongated arm, having a lower free end, which protrudes downward;

(c) a connecting element in which a respective end portion of each of said two upwardly protruding upper arms and said lower elongated arm are received and connected to one another to form a Y-shaped frame in which the upwardly protruding upper arms converge toward each other as the upwardly protruding upper arms approach the connecting element; and (d) a fastening element for suspending and hanging the wind instrument or removably fastening a holding element for hanging the wind instrument, said fastening element being attached on the connecting element, wherein said two upwardly protruding upper arms are formed as arcs on their free end, provided to rest on the shoulders of a player, and wherein said lower elongated arm forms a support for supporting the carrying device, which is adapted to lie with its lower free end above the navel on the belly of the player.

2. The carrying device according to claim 1, wherein the two upwardly protruding upper arms are produced from an easily bendable metal.

3. The carrying device according to claim 1, wherein the carrying device is produced completely from plastic or at least partially from metal.

4. The carrying device according to claim 1, wherein the two upwardly protruding upper arms are integrally formed with the support and the connecting element to form a unit.

5. The carrying device according to claim 1, wherein the connecting element is fixedly connected to the support or formed thereon, and the two upwardly protruding upper arms are removably plugged into recesses in the connecting element, in such a manner that they are not pivotable when in a latched state.

6. The carrying device according to claim 1, wherein the connecting element is fixedly connected to the support or formed thereon, and the two upwardly protruding upper arms are linked by a hinge-type connection on the connecting element to enable the carrying device to transition to a collapsed configuration in which the upper arms point down.

7. The carrying device according to claim 1, wherein the support comprises a brace, which is formed on the support, or is formed by widening the support in a lower end region.

8. The carrying device according to claim 1, wherein the support has a brace, which is rotatable and is arranged on the support.

9. The carrying device according to claim 1, wherein the support has a telescopic extension.

10. The carrying device according to claim 1, wherein the arced free ends of the two upwardly protruding upper arms are flattened and have a cushion.

11. The carrying device according to claim 1, wherein the fastening element is formed by an eye and the holding element includes an adjustable band and a hook.

12. The carrying device according to claim 11, wherein the hook is U-shaped and is manufactured from steel with a plastic sheath and has a safeguard, which prevents unintended disengagement of the hook from the eye on the instrument during playing, wherein the safeguard consists of a cam, which is formed on an inner side of the U-shaped hook, or is formed onto a free end of a spring tongue arranged on the inner side of the U-shaped hook.

13. The carrying device according to claim 1, wherein said lower elongated arm is sized relative to the upper arms such that the support engages the player above the navel on the belly of the player when the arcs on the free ends of the upper arms rest on the shoulders of the player.

14. The carrying device according to claim 1, wherein said lower elongated arm includes a brace positioned to engage the player above the navel of the player when the arcs on the free ends of the upper arms rest on the shoulders of the player.

15. The carrying device according to claim 1, wherein said lower elongated arm includes a brace positioned to unattachably rest on the player above the navel of the player when the arcs on the free ends of the upper arms rest on the shoulders of the player.

* * * * *